US005630702A

United States Patent [19]

Marmilic et al.

[11] Patent Number: 5,630,702

[45] Date of Patent: May 20, 1997

[54] ARRANGEMENT FOR INFLUENCING THE RADIAL CLEARANCE OF THE BLADING IN AXIAL-FLOW COMPRESSORS INCLUDING HOLLOW SPACES FILLED WITH INSULATING MATERIAL

[75] Inventors: Robert Marmilic, Nussbaumen; François Meynard; Roger Suter, both of Zürich, all of Switzerland

[73] Assignee: Asea Brown Boveri AG, Baden, Switzerland

[21] Appl. No.: 556,074

[22] Filed: Nov. 2, 1995

[30] Foreign Application Priority Data

Nov. 26, 1994 [DE] Germany ..... 44 42 157.5

[51] Int. Cl.[6] ..... F01D 25/08

[52] U.S. Cl. ..... 415/177; 415/173.1; 415/178

[58] Field of Search ..... 415/173.1, 177, 415/178

[56] References Cited

U.S. PATENT DOCUMENTS

| | | | |
|---|---|---|---|
| 2,547,934 | 4/1951 | Gill | 415/177 |
| 3,304,054 | 2/1967 | Oechslin et al. | 415/177 |
| 3,997,758 | 12/1976 | Patel | 415/177 |
| 4,522,559 | 6/1985 | Burge et al. | 415/196 |
| 4,762,462 | 8/1988 | Lardellier | 415/177 |
| 5,314,303 | 5/1994 | Charbonnel et al. | 415/173.1 |

FOREIGN PATENT DOCUMENTS

| | | |
|---|---|---|
| 4331060C1 | 6/1994 | Germany . |
| 639171 | 10/1983 | Switzerland . |

*Primary Examiner*—Edward K. Look
*Assistant Examiner*—Christopher Verdier
*Attorney, Agent, or Firm*—Burns, Doane, Swecker & Mathis

[57] ABSTRACT

In an arrangement for influencing the radial clearance of the blading of an axial-flow, highly loaded compressor which essentially comprises a rotor (1) equipped with moving blades (2) and a blade carrier (3) which is equipped with guide blades (4) and is hung in a casing (5), the blade carrier (3) has long and narrow mountings (7) for the guide blades (4), at least one hollow space (9) being arranged in the guide-blade roots (8), a hollow space (10) being present in each case in the embedded state in the peripheral direction between the guide-blade root (8), the two mountings (7) for a guide blade (4) and the blade carrier (3), a further hollow space (11) being present in each case in the peripheral direction between the blade carrier (3) and the mountings (7) for two successive guide blades (4), which hollow space (11) is defined by a plurality of segments (12) distributed over the periphery and connected to the guide-blade roots (8), and the hollow spaces (9, 10, 11) being filled with insulating material (15).

8 Claims, 4 Drawing Sheets

ARRANGEMENT FOR INFLUENCING THE RADIAL CLEARANCE OF THE BLADING IN AXIAL-FLOW COMPRESSORS INCLUDING HOLLOW SPACES FILLED WITH INSULATING MATERIAL

BACKGROUND OF THE INVENTION

1. Field of the Invention

The invention relates to an arrangement for influencing the radial clearance of the blading in axial-flow, highly loaded compressors of gas turbines.

2. Discussion of Background

Due to the present high economic and ecological requirements, higher and higher efficiencies are aimed at in modern thermal turbomachines, for example industrial gas turbines, which also leads, inter alia, to higher pressure and temperature ratios in the compressor.

This higher loading of the compressor can be realized with shorter blades, but this leads to an increase in the relative radial clearance, related to the blade height, of the moving blades and thus to a reduction in the pumping limit of the compressor.

In addition, it is known that the gap losses in the gap between the moving blades of the rotor of thermal turbomachines and the stator parts opposite them have a great effect on the efficiency of the machine. The greater the gap losses, the lower the efficiency. Attempts are therefore made to keep the gap as narrow as possible during operation, but large enough for the cooling phase.

The radial clearance is caused on the one hand by inaccuracies during production and assembly but on the other hand in particular by the different thermal behavior of the rotor and the blade carrier.

The rotor is usually more solid than the blade carrier on account of the strength requirements. Since both the heat-transfer conditions and usually the material for both parts are similar, the rotor is therefore thermally substantially slower. There is also the fact that not only are the thermal expansions of rotor and blade carrier different in the operating state, but also their variation with time is different, especially during start-up and stopping of the machine. In interaction with the centrifugal force, this results in a minimum radial clearance during the start in the hot state just after the stopping and a maximum radial clearance during the start in the cold state.

It is known from CH 639 171 that a reduction in the radial gap in axial turbomachines can be achieved through the use of cover rings which are in one piece in the peripheral direction, are arranged one behind the other in the axial direction of the machine and are centered by centering wedges. These rings have temperatures which are rotationally symmetric all round at each operating point, for which reason the circular form is retained and the cover rings thus remain centered to the rotor axis in the event of deformations as a result of temperature changes, so that the minimum gap size, to be taken into account in the design, between rotor wheel and cover ring can be reduced. If the cover rings are used at the same time for mounting and holding the guide-blade rims arranged between them, the gap, likewise causing power losses, between the inner guide-blade end (possibly shroud band) and the rotor can be minimized, too. Since the cover rings should be made of a material having as low a coefficient of thermal expansion as possible, for example an iron-nickel alloy, they are relatively expensive. A further disadvantage with this prior art is the complicated construction which results from the fastening of the centering wedges and their centering.

DE 33 05 170 C2 discloses a turbomachine casing having an outer casing wall and an inner casing wall subdivided into sectors in the peripheral direction, both being connected to one another via detachable fastenings, in which the sectors of the inner casing wall are formed by retaining rails which have a clearance space at their ends in the peripheral direction and which are provided with radial supporting extensions and form intermediate spaces between the inner and outer casing wall which are filled with thermal insulating material. A disadvantage with this prior art is the splitting-up of the blade carrier into an outer and an inner casing wall, in which case only thin guide-blade roots can be accommodated on account of the thin inner casing wall, and the forces which occur are transmitted via the root and the inner casing wall to the outer casing wall.

SUMMARY OF THE INVENTION

Accordingly, one object of the invention, in attempting to avoid all these disadvantages, is to provide in an axial-flow, highly loaded compressor a novel arrangement for influencing the radial clearance of the blading, which arrangement enables the radial gap between moving blades and blade carrier to be kept small and at an approximately constant level in a simple manner during different operating conditions of the machine.

According to the invention, in an axial-flow, highly loaded compressor which essentially comprises a rotor equipped with moving blades and a blade carrier which is equipped with guide blades and is hung in a casing, this is achieved when the blade carrier has long and narrow mountings for the guide blades, at least one hollow space being arranged in the guide-blade roots, and when a hollow space is present in each case in the embedded state in the peripheral direction between the guide-blade root, the two mountings for a guide blade and the blade carrier, and when a further hollow space is present in each case in the peripheral direction between the blade carrier and the mountings for two successive guide blades, which hollow space is defined by a plurality of segments distributed over the periphery and connected to the guide-blade roots, and when the hollow spaces are filled with insulating material.

The advantages of the invention can be seen, inter alia, in the fact that the stator, compared with the prior art, is now thermally slower during the starting phase and the stopping phase and the radial clearance between the moving blades and the stator is thereby reduced so that the pumping limit is raised and the efficiency of the compressor increases. A complicated two-piece casing divided in the peripheral direction is not necessary.

It is advantageous when the segments are designed as arched plates or when they have an arched, plate-shaped base on which in each case at least one hook extends in the direction of the blade carrier at the sides toward the mountings. The hooks prevent possible undesirable arching of the segments on account of increased temperatures.

In addition, it is convenient when the segments are connected to the guide-blade roots via springs. The springs press guide blades and segments into the operating position and at the same time have a sealing function.

Furthermore, it is advantageous when the height of the mounting is at least half the blade height and the width of the mounting corresponds at most to a third of the width of the blade root of the guide blade. In this case, there is a particularly great reduction in the heat transfer from the compressor duct to the blade carrier.

It is convenient to use static air as insulating material. This is cheaper than the use of expensive fillers. In this context it is advantageous when a plate is additionally pushed into two peripheral slots of the hooks of a segment and is bent virtually at right angles at the ends of each segment so that a hollow space for the static air results. In this way, an undesirable heat transfer on account of free convection is prevented.

If heating means, for example an electric heater, which can be switched on alternatively, e.g. during the hot-start phase, are additionally arranged in the blade carrier, active influencing of the radial clearance can be achieved in addition to the aforesaid passive influencing of the radial clearance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show an axial-flow high-pressure compressor part of a gas turbine and wherein.

Only the elements essential for understanding the invention are shown. Elements of the plant which are not shown are, for example, the inlet portions of the compressor part and the following equipment, for example the combustion chamber and the turbine. The direction of flow of the working media is designated by arrows.

DESCRIPTION OF THE PREFERRED EMBODIMENTS

Figure 1:
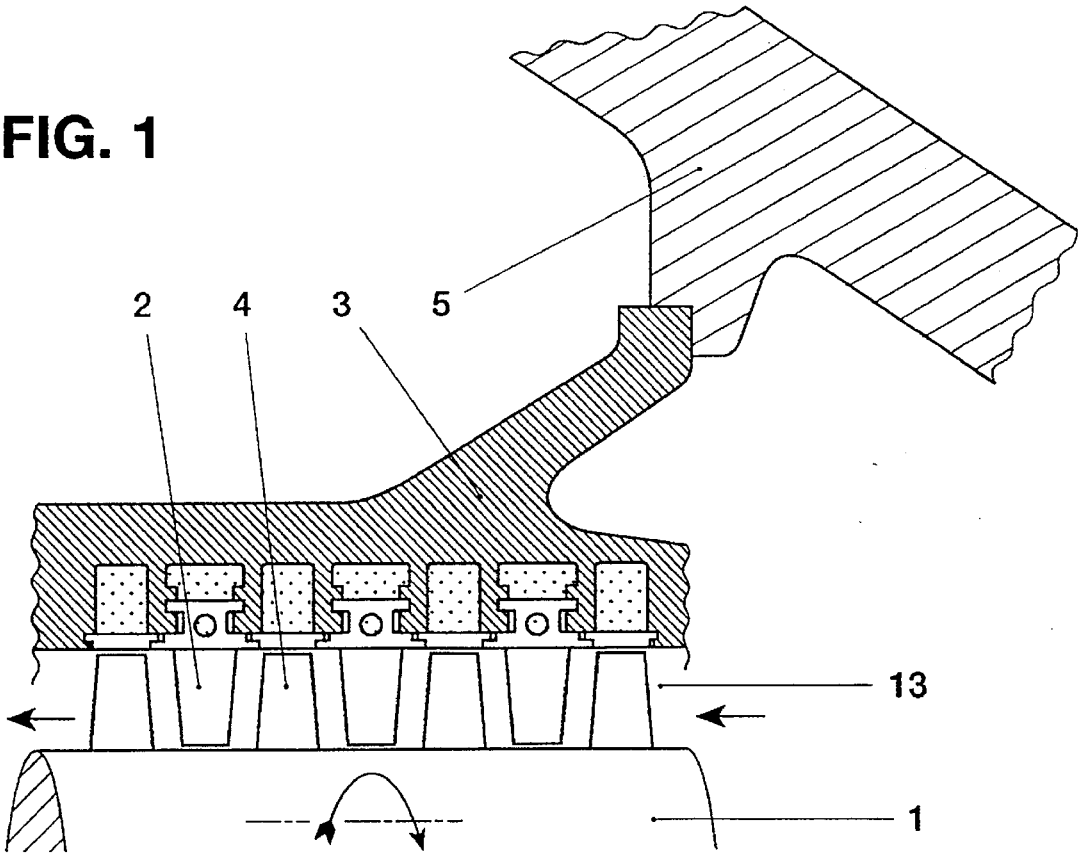
FIG. 1 shows a partial longitudinal section of the compressor.

Referring now to the drawings, wherein like reference numerals designate identical or corresponding parts throughout the several views, FIG. 1 shows a partial longitudinal section of an axial-flow, multi-stage high-pressure compressor of a gas turbine plant, only the last stages being shown. The compressor essentially comprises the rotor 1, which is equipped with moving blades 2, and the blade carrier 3 carrying the guide blades 4. The blade carrier is hung in an outer casing 5 of the compressor, which outer casing 5 is connected to a turbine casing (not shown here), e.g. via flange connections.

Figure 2:
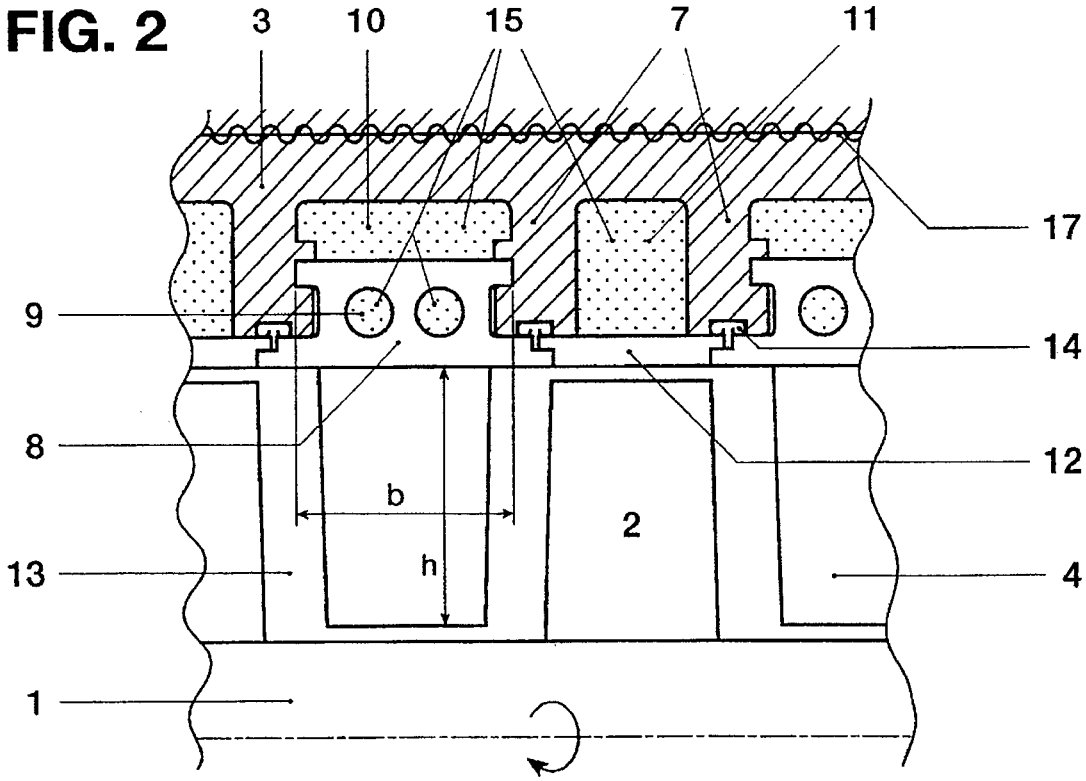
FIG. 2 shows an enlarged partial longitudinal section from FIG. 1 in the area of the blade carrier and the blades, plate-shaped segments being arranged between the guide-blade roots.

FIG. 2 shows an enlarged detail of FIG. 1 in the area of the blade carrier 3 and the blades 2, 4. The blade carrier 3 has a special configuration such that it has long and narrow mountings 7 having peripheral slots in which the guide blades 4 are embedded. The mountings 7 are preferably at least as high as half the blade height h, and their width is at most a third of the width b of the blade root 8 of the guide blade 4. They are poor conductors of heat.

Two hollow spaces 9 are located in the guide-blade root 8, which is of very thick and solid design. The thermal conductivity through the guide-blade root 8 is reduced by this geometry. At the same time this leads to good mechanical properties.

Since the height of the blade root 8 is substantially smaller than the height of the mountings 7, a hollow space 10 is obtained in the embedded state between the root 8 of the guide blade 4, the two mountings 7 for the guide blade 4, and the blade carrier 3.

A further hollow space 11 is arranged in the blade carrier 3 between the mountings 7 of two successive guide blades 4. This hollow space 11 is defined by a plurality of segments 12 which are distributed over the periphery, are connected to the guide-blade roots 8 and in this exemplary embodiment are designed as arched plates. The segments 12 define the compressor flow duct 13 on their bottom side in the area of the moving blades 2. They are connected to the guide-blade roots 8 via springs 14, which partly have a sealing function and can be C-rings for example, so that there is only contact between the segments 12 and the guide-blade roots 8. The springs 14 press the guide blades 2 and the segments 12 into the operating position.

In this exemplary embodiment, the hollow spaces 9, 10, 11 are filled with solid, immovable insulating material 15 so that undesirable effects such as leakage and radiation are prevented.

As shown in FIG. 2, a temperature-input means 17, for example an electric, preferably inductive, heater, can be arranged inside the blade carrier 3, which heater is switched on when required, specifically during the hot start of the machine. By the heat thereby fed to the stator, the minimum radial clearance at the pinch point is increased, since the radius of the stator remains constant.

Figure 3:
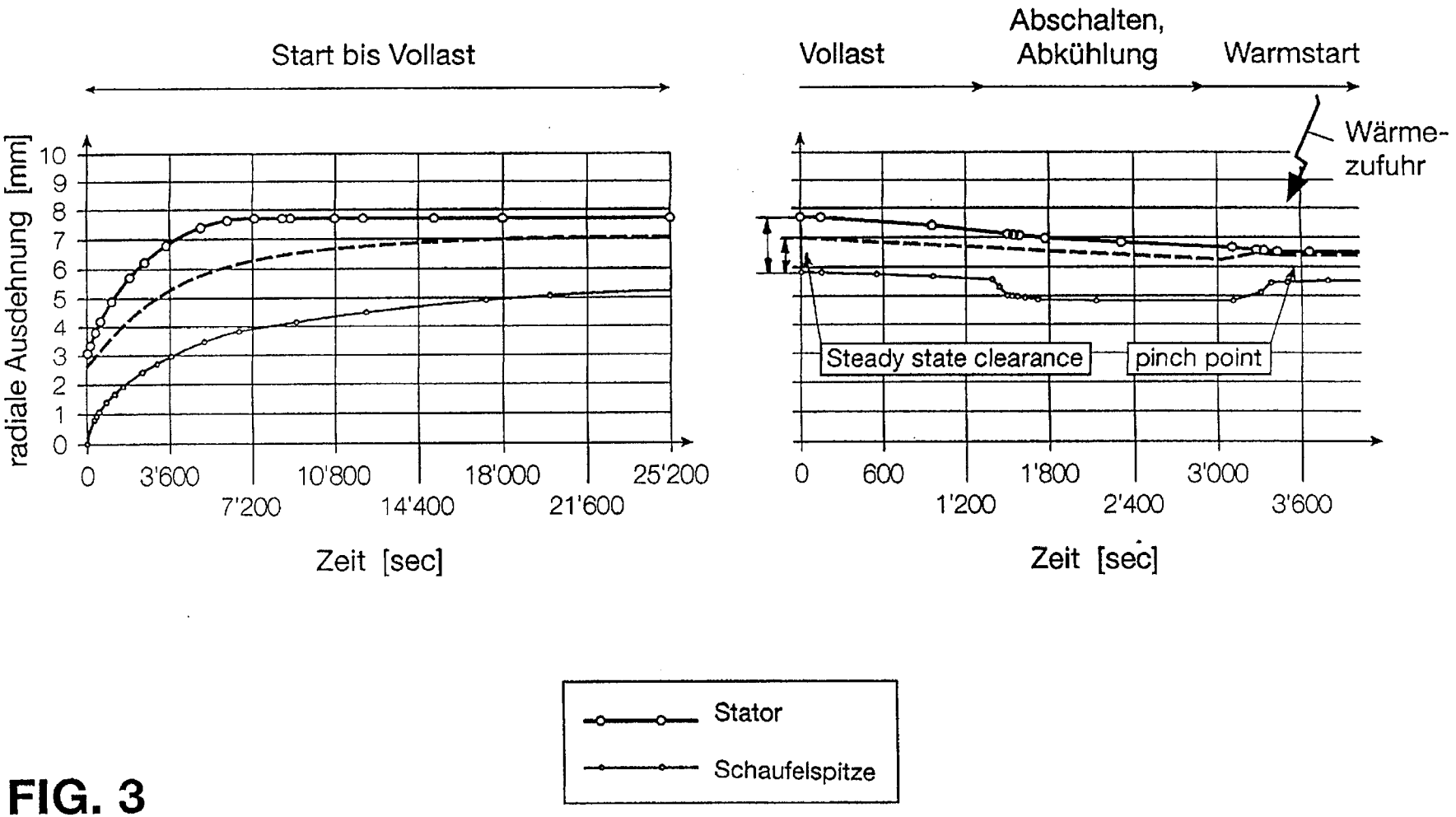
FIG. 3 shows a schematic representation of the dependency of the radial clearance size on the load state and on time for the rotor and stator of a compressor according to FIG. 2.

FIG. 3 clearly shows this. Here, the radial clearance is shown as a function of time or various operating conditions in the compressor. The solid lines represent the relationships according to the prior art; the broken line shows the dependency for the stator according to the solution according to the invention.

During the start phase and in operation under full load, the radial clearance between stator and the moving blades of the rotor is reduced, since the stator slows down thermally on account of the hindrance of the heat transfer from the compressor duct, which hindrance is achieved by the invention. This means that the stator also cools down more slowly, but still more quickly than the rotor, after the shut-off of the machine. If the radius of the stator is now kept constant during the hot start by switching on the electric heater already mentioned, preferably an inductive heater, and the heat input associated therewith, the radial clearance present during the hot start just after stopping is no longer so small, and damage to the blades need no longer be feared.

Figure 4:
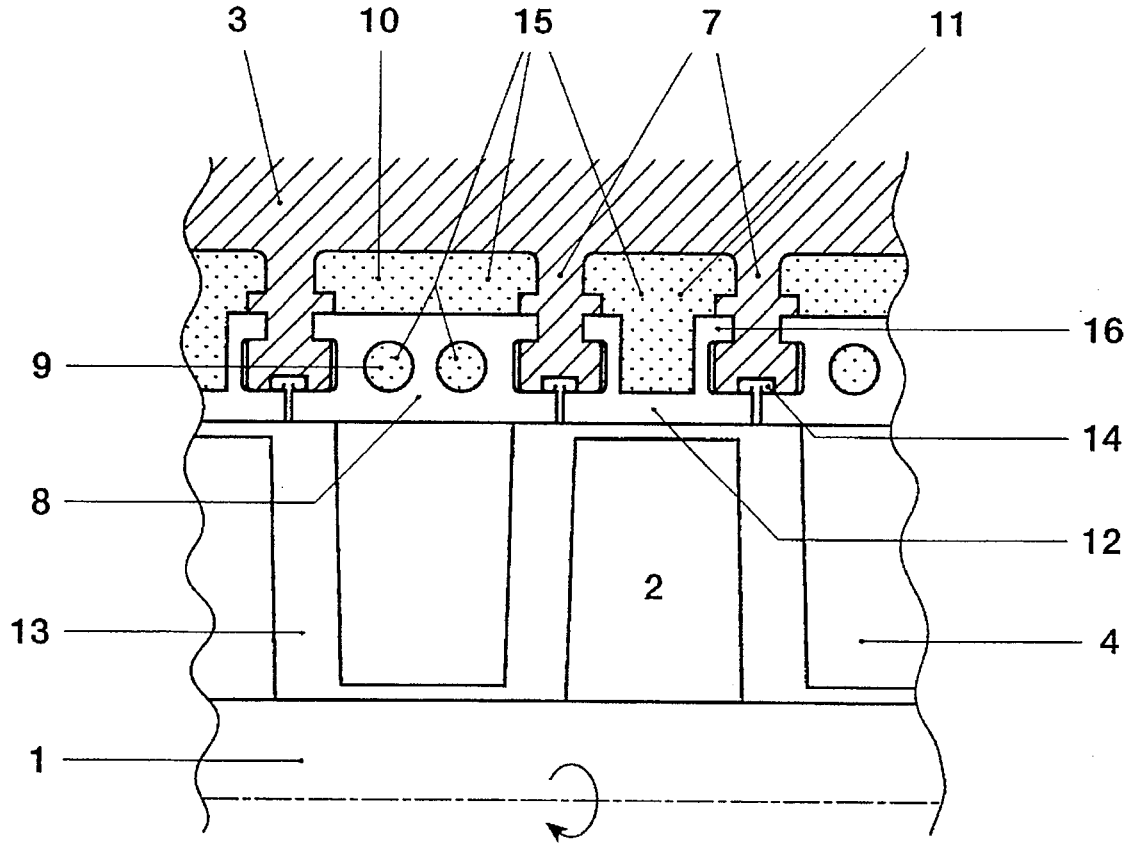
FIG. 4 shows an enlarged partial longitudinal section from FIG. 1 in the area of the blade carrier and the blades, where segments having hooks are used.

FIG. 4 shows a second exemplary embodiment, which differs from the exemplary embodiment described above primarily in the segment form used. The segments 12 here have an arched, plate-shaped base on which in each case a hook 16 extends in the direction of the blade carrier 3 at the sides toward the mountings 7. Therefore the segment 12 here comprises a unit of base plate and hooks 16. Although the hooks 16 increase the number of heat transfers compared with the above embodiment variant, they prevent possible arching of the segments 12, which would result in a greater radial clearance. A known solid filler which fills the hollow spaces 9, 10 and 11 is again used here as insulating material 15.

Figure 5:
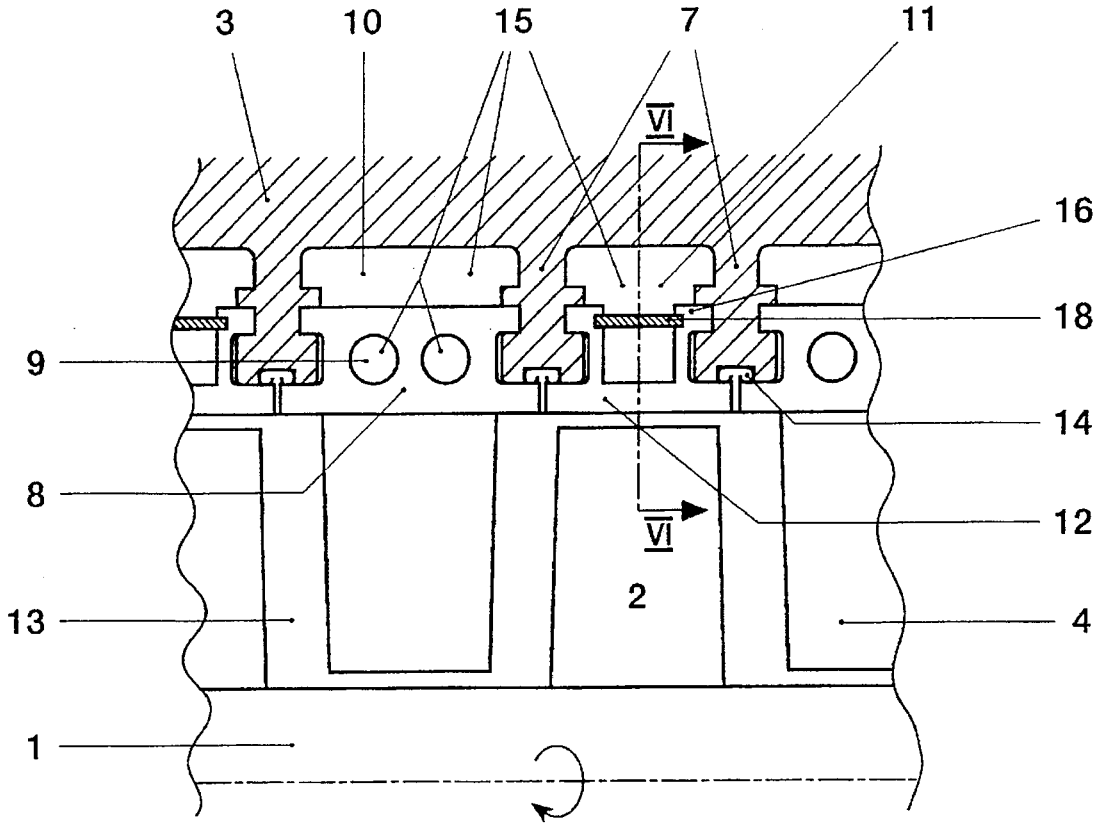
FIG. 5 shows an enlarged partial longitudinal section analogous to FIG. 4, static air being used as insulating material.
Figure 6:
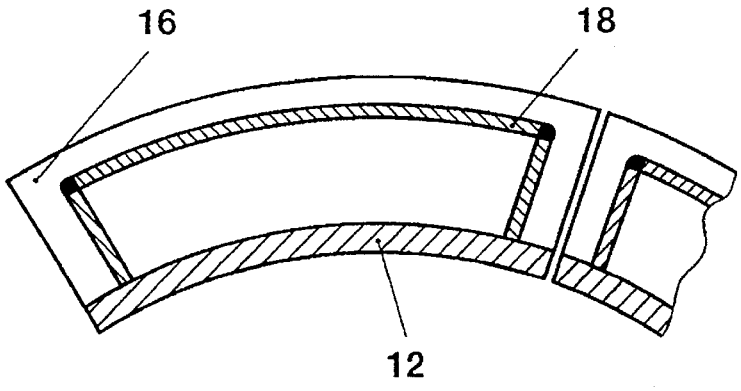
FIG. 6 shows a section along plane VI—VI in FIG. 5.

Finally, FIGS. 5 and 6 show an exemplary embodiment in which segments 12 having hooks 16 which form a unit are used in a similar manner to the second exemplary embodiment. Insulation consisting of static air is located behind the segments 12. When static air is used as insulating material, a closed hollow space is created for the static air by means of additional plates 18 which are each pushed into two peripheral slots of the segments 12 (specifically in the area of the hooks 16) and are bent virtually at right angles at the end of each segment, which hollow space encapsulates each segment 12 and prevents air circulation (see FIG. 5). Without the fitting of the plates 18, an undesirable heat transfer could take place on account of free convection. In view of the assembly requirements, the blade carrier 3 is axially split by a dividing plane.

By the special configuration of the blade carrier 3 having narrow and long heat-conducting paths, the heat transfer from the compressor duct 13 to the blade carrier 3 is hindered and thus the thermal behavior of the blade carrier 3, compared with the prior art, is brought into line with the level of the rotor 1 within the range of the starting phase and the stopping phase.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An arrangement for influencing radial clearance of blading of an axial-flow, highly loaded compressor comprising a rotor equipped with moving blades and a blade carrier which is equipped with guide blades, the compressor being hung in a casing, wherein the blade carrier has mountings for the guide blades, at least one first hollow space arranged in roots of the guide-blades, at least one second hollow space being disposed in an embedded state in a peripheral direction between the guide-blade roots, the mountings and the blade carrier, at least one third hollow space being disposed in a peripheral direction between the blade carrier and ones of the mountings for two successive ones of the guide blades, the third hollow space being defined by a plurality of segments distributed over a periphery of the blade carrier and connected to the guide-blade roots, and the first, second, and third hollow spaces being filled with insulating material.

2. The arrangement as claimed in claim 1, wherein the segments are designed as arched plates.

3. The arrangement as claimed in claim 1, wherein the segments have an arched, plate-shaped base on which at least one hook extends in a direction of the blade carrier toward the mountings.

4. The arrangement as claimed in claim 2, wherein the segments are connected to the guide-blade roots via springs.

5. The arrangement as claimed in claim 1, wherein the mountings are at least half of a height of the blades and the mountings are at most a third of a width of the guide-blade roots.

6. The arrangement as claimed in claim 1, wherein static air is used as the insulating material.

7. The arrangement as claimed in claim 6, wherein the segments have an arched, plate-shaped base on which at least one hook extends in a direction of the blade carrier toward the mountings, and wherein a plate is pushed into two peripheral slots of the at least one hook of one of the segments and is bent substantially at a right angle at ends of the segment so that a hollow space for the static air results.

8. The arrangement as claimed in claim 1, wherein heating means are arranged in the blade carrier.

* * * * *